US006343850B1

(12) United States Patent
Domagall

(10) Patent No.: US 6,343,850 B1
(45) Date of Patent: Feb. 5, 2002

(54) INK JET POLYETHER URETHANE WIPER BLADE

(75) Inventor: Kathryn A. Domagall, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/407,309

(22) Filed: Sep. 28, 1999

(51) Int. Cl.[7] ..... B41J 2/165
(52) U.S. Cl. ..... 347/33
(58) Field of Search ..... 347/33; 525/329.3, 525/338; 15/250.361

(56) References Cited

U.S. PATENT DOCUMENTS

| | | | | | |
|---|---|---|---|---|---|
| 3,980,595 | A | * | 9/1976 | Schonfeld et al. | 260/3 |
| 4,251,824 | A | | 2/1981 | Hara et al. | 347/57 |
| 4,376,945 | A | * | 3/1983 | Hara et al. | 347/67 |
| 4,410,899 | A | | 10/1983 | Haruta et al. | 347/56 |
| 4,412,224 | A | | 10/1983 | Sugitani | 347/65 |
| 4,532,530 | A | | 7/1985 | Hawkins | 347/62 |
| 4,567,494 | A | | 1/1986 | Taylor | 347/30 |
| 4,601,777 | A | | 7/1986 | Hawkins et al. | 216/27 |
| 4,638,337 | A | | 1/1987 | Torpey et al. | 347/65 |
| 4,849,774 | A | | 7/1989 | Endo et al. | 347/56 |
| 4,853,717 | A | | 8/1989 | Harmon et al. | 347/29 |
| 4,861,819 | A | * | 8/1989 | Theodore et al. | 524/491 |
| 5,065,158 | A | | 11/1991 | Nojima et al. | 347/33 |
| 5,151,715 | A | | 9/1992 | Ward et al. | 347/33 |
| 5,396,271 | A | | 3/1995 | Premnath | 347/33 |
| 5,548,310 | A | | 8/1996 | Binnert et al. | 347/33 |
| 5,555,461 | A | | 9/1996 | Ackerman | 347/33 |
| 5,594,427 | A | | 1/1997 | Kim et al. | 340/825.72 |
| 5,790,146 | A | | 8/1998 | Anderson | 347/28 |
| 5,793,390 | A | | 8/1998 | Claffin et al. | 347/33 |

FOREIGN PATENT DOCUMENTS

| | | | | |
|---|---|---|---|---|
| EP | 0 475 424 | * | 3/1992 | 347/33 |

* cited by examiner

*Primary Examiner*—N. Le
*Assistant Examiner*—Shih-Wen Hsieh
(74) *Attorney, Agent, or Firm*—Amette Bade

(57) ABSTRACT

An ink jet assembly having a) a printhead with at least one nozzle to disperse inks, and having b) a wiper blade assembly positioned for cleaning ink and other debris from the printhead nozzle(s), the wiper blade assembly having at least one wiper blade preferably comprising a polyether urethane.

19 Claims, 3 Drawing Sheets

INK JET POLYETHER URETHANE WIPER BLADE

BACKGROUND OF THE INVENTION

The present application relates to blade materials useful in an ink jet printing apparatus, including a thermal ink jet printing apparatus, and specifically to a blade material useful in an ink jet printing wiper blade, used therein to remove ink and other debris from nozzle faces of ink jet printheads. In preferred embodiments, the wiper blade is a polyether urethane.

Ink jet printing systems generally are of two types: continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

Since drop-on-demand systems require no ink recovery, charging, or deflection, the system is much simpler than the continuous stream type. There are three types of drop-on-demand ink jet systems. One type of drop-on-demand system has as its major components an ink filled channel or passageway having a nozzle on one end and a piezoelectric transducer near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies. Drop-on-demand systems which use piezoelectric devices to expel the droplets also suffer the disadvantage of a slow printing speed.

Another type of drop-on-demand system is known as acoustic ink printing. As is known, an acoustic beam exerts a radiation pressure against objects upon which it impinges. Thus, when an acoustic beam impinges on a free surface (i.e., liquid/air interface) of a pool of liquid from beneath, the radiation pressure which it exerts against the surface of the pool may reach a sufficiently high level to release individual droplets of liquid from the pool, despite the restraining force of surface tension. Focusing the beam on or near the surface of the pool intensifies the radiation pressure it exerts for a given amount of input power. Acoustic ink printers typically comprise one or more acoustic radiators for illuminating the free surface of a pool of liquid ink with respective acoustic beams. Each of these beams usually is brought to focus at or near the surface of the reservoir (i.e., the liquid/air interface). Furthermore, printing conventionally is performed by independently modulating the excitation of the acoustic radiators in accordance with the input data samples for the image that is to be printed. This modulation enables the radiation pressure which each of the beams exerts against the free ink surface to make brief, controlled excursions to a sufficiently high pressure level for overcoming the restraining force of surface tension. That, in turn, causes individual droplets of ink to be ejected from the free ink surface on demand at an adequate velocity to cause them to deposit in an image configuration on a nearby recording medium. The acoustic beam may be intensity modulated or focused/defocused to control the ejection timing, or an external source may be used to extract droplets from the acoustically excited liquid on the surface of the pool on demand. Regardless of the timing mechanism employed, the size of the ejected droplets is determined by the waist diameter of the focused acoustic beam. Acoustic ink printing is attractive because it does not require the nozzles or the small ejection orifices which have caused many of the reliability and pixel placement accuracy problems that conventional drop on demand and continuous stream ink jet printers have suffered.

Still another type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble formation or nucleation of around 280° C. Once nucleated, the bubble or water vapor thermally isolates the ink from the heater and no further heat can be applied to the ink. This bubble expands until all the heat stored in the ink in excess of the normal boiling point diffuses away or is used to convert liquid to vapor, which removes heat due to heat of vaporization. The expansion of the bubble forces a droplet of ink out of the nozzle, and once the excess heat is removed, the bubble collapses on the resistor. At this point, the resistor is no longer being heated because the current pulse has passed and, concurrently with the bubble collapse, the droplet is propelled at a high rate of speed in a direction towards a recording medium. The resistive layer encounters a severe cavitational force by the collapse of the bubble, which tends to erode it. Subsequently, the ink channel refills by capillary action. This entire bubble formation and collapse sequence occurs in about 10 microseconds. The channel can be refired after 100 to 500 microseconds minimum dwell time to enable the channel to be refilled and to enable the dynamic refilling factors to become somewhat dampened. Thermal ink jet processes are well known and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are incorporated herein by reference in their entirety.

Operation of a thermal ink jet printer is described in, for example, U.S. Pat. No. 4,849,774.

One particular form of thermal ink jet printer is described in U.S. Pat. No. 4,638,337. The described printer is of the carriage type and has a plurality of printheads, each with its own ink supply cartridge, mounted on a reciprocating carriage.

There is a need to periodically clean the orifices of the ink ejecting orifices of an ink jet printer when the printer is in use. During the priming operation, which usually involves either forcing or drawing ink through the printhead, allows for drops of ink on the face of the printhead to build up. Ultimately, a build-up of ink residue forms on the printhead face. The residue can have a deleterious effect on print quality. In addition, paper fibers and other foreign material can collect on the printhead face while printing is in progress and, like the ink residue, can also have a deleterious effect on print quality.

U.S. Pat. No. 4,853,717, discloses the process of moving a printhead across a wiper blade at the end of a printing operation so that paper dust and other contaminants are scraped off the orifice plate before the printhead is capped.

U.S. Pat. No. 5,151,715 to Ward et al. discloses a printhead wiper for ink jet printers molded from an elastomer and including a wiping beam having a wiping edge formed at one end of the beam. The other end of the beam is integral with a base.

U.S. Pat. No. 5,065,158 to Nojima et al. discloses a cleaning member positioned to bear against the discharge port forming surface of an ink jet recording head, which contains the discharge ports therein, to thereby clean the discharge port forming surface. The cleaning member is formed of a material composed chiefly of hydrogenated nitrile butadiene rubber.

U.S. Pat. No. 5,396,271, discloses a wiper blade cleaning system which has two polyurethane wiping blades of unequal lengths, but which are otherwise identical.

U.S. Pat. No. 5,555,461 discloses a wiper blade cleaning system that has at least one polyurethane wiping blade releasably mounted in a slot on a planar surface of a fixed structural member.

Known wiper blade materials have been made of robust materials. However, these materials such as urethane materials, have been known to swell in the presence of liquid inks. Other useful robust materials include fluoroelastomers, and in particular, those fluoroelastomers sold under the tradename VITON® from DuPont. However, these materials are expensive, costing up to $1,000/pound. Known materials are also spincast and cannot be molded relatively easy.

Therefore, it is desired to provide a wiper blade comprised of materials which provide for a decrease in swelling in the presence of inks. In addition, it is desired to provide a wiper blade material which is relatively cheaper than known wiper blade materials. In addition, it is desired to provide a wiper blade material which can be molded to any desired shape with relative ease.

SUMMARY OF THE INVENTION

An object of the present invention includes: an ink jet assembly comprising a) a printhead having at least one nozzle to disperse inks; b) a wiper blade assembly positioned for cleaning ink and other debris from the at least one printhead nozzles, wherein the wiper blade assembly comprises at least one wiper blade, and wherein the wiper blade comprises polyether urethane.

In addition, another object of the present invention includes: an ink jet assembly comprising a) a printhead having at least one nozzle to disperse inks; b) a wiper blade assembly positioned for cleaning ink and other debris from the at least one printhead nozzle, wherein the wiper blade assembly comprises at least one wiper blade, and wherein the wiper blade comprises diphenylmethane diisocyanate polyether urethane.

Further, an object of the present invention includes: a process for cleaning ink and other debris from a surface of at least one printhead nozzle in an ink jet assembly comprising a) dispersing inks from at least one printhead nozzle to a substrate, b) cleaning ink and other debris from the at least one printhead nozzle by positioning a wiper blade assembly comprising at least one wiper blade so that the wiper blade cleans the ink and other debris from the at least one printhead nozzle, wherein the wiper blade comprises polyether urethane.

BRIEF DESCRIPTION OF THE FIGURES

Other features of the present invention will become apparent from the following description and upon reference to the drawings, in which.

DETAILED DESCRIPTION OF THE INVENTION

The blade assembly can be used with various ink jet printing apparatuses including thermal ink jet, piezoelectric ink jet, acoustic or bubble ink jet, and other ink jet machines.

Generally, an ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels. In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then refilled by capillary action, which in turn draws ink from a supply container.

Figure 1:
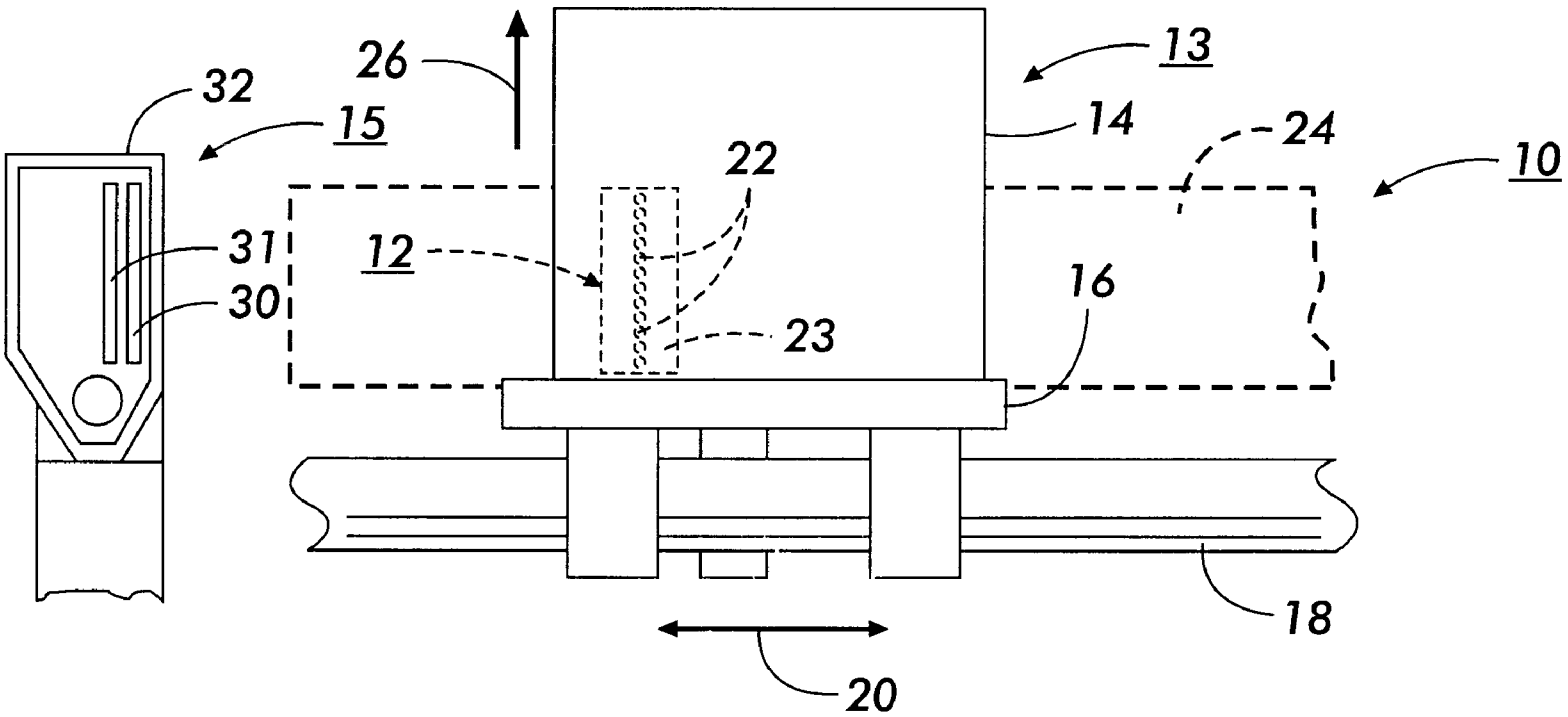
FIG. 1 is a schematic front elevational view of a partially shown ink jet printer having a maintenance station incorporating an embodiment of a cleaning blade assembly of the present invention.

FIG. 1 demonstrates an example of an ink jet printer assembly. FIG. 1 is not intended to limit the scope of the present wiper blade. The presently described wiper blade can be used with other ink jet printer assembly designs. The printer 10 shown in FIG. 1 has a printhead 12, shown in dashed line, which is fixed to ink supply cartridge 14. The cartridge is removably mounted on carriage 16, and is translatable back and forth on guide rails 18 as indicated by arrow 20, so that the printhead and cartridge move concurrently with the carriage. The printhead contains a plurality of ink channels (not shown) which terminate in at least one nozzle 22 in nozzle face 23 (both shown in dashed line) and carry ink from the cartridge to respective ink ejecting at least one nozzle 22. When the printer is in the printing mode, the carriage translates or reciprocates back and forth across and parallel to a printing zone 24 (shown in dashed line) and ink droplets (not shown) are selectively ejected on demand from the printhead nozzle(s) onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, the disclosures of which are hereby incorporated by reference in their entirety.

At the end of a printing operation or termination of the printing mode by the printer 10, the carriage 16 is first moved past the wiper blade cleaning assembly 15 comprising at least one and preferably more than one releasably mounted wiper blades. FIG. 1 demonstrates a preferred embodiment of the invention including two mounted wiper blades 30 and 31 in a fixed structural member 32, more fully discussed later, so that the printhead nozzle face 23 is wiped free of ink and debris every time the printhead and cartridge (hereinafter print cartridge 13) enters or exits the maintenance station. Following cleaning of the printhead nozzle(s), the carriage 16 moves back to its original position in the direction of arrow 20.

Figure 3:
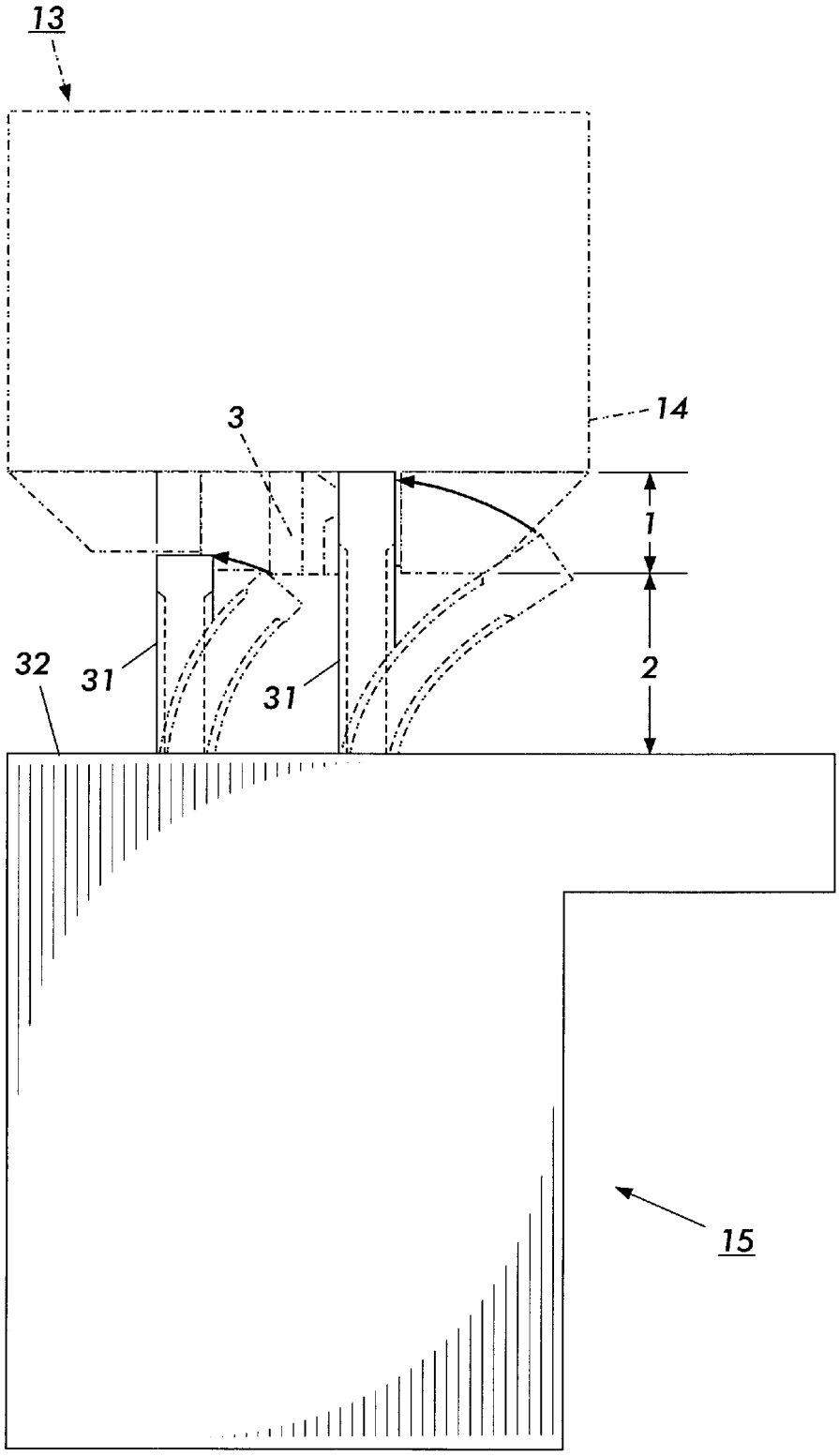
FIG. 3 is an enlarged view of an embodiment of a print head in combination with a wiper blade, detailing the free length and interference.

Referring to FIGS. 1 and 3, after a print cartridge 13 has undergone a prime operation, the print cartridge next proceeds toward the wiper blade assembly 15, whereat in a preferred embodiment, blade 31 precedes the blade 30 in its cleaning action. In a preferred embodiment, one blade can be longer than the other blade. Preferably in an embodiment having two blades, blade 31 can proceed a longer blade 30. The stiffer, shorter blade serves to remove ink efficiently off the front surface of the printhead face 23 and most of the ink off the other components making up the nozzle face as well. However, due to its stiffness, and because the surface topography of the printer cartridge nozzle face is characterized by discontinuities, the shorter blade can chatter and small amounts of ink (not shown) may be deposited in pockets 87. In a preferred embodiment, the longer, complaint wiper blade 30 that follows in the wake of the shorter blade 31 removes the last vestige of ink remaining on the nozzle face. Thus, the two blades 30 and 31 complement one another. The shorter, more efficient, stiffer blade succeeds in removing the lion's share of the ink off the front face of the cartridge, but it can leave some ink behind. The longer, less stiff blade has limited ink removal capability, but it is superior in handling non-coplanar surfaces and removes the ink that is left behind by the shorter blade through is conformability about surface discontinuities or irregularities. Any ink removed by the wiper blades is transported by capillary action along the grooves 62 to the absorbent pad 41.

In the preferred embodiment, spacing between the wiper blades 30 and 31 is about 3 mm, and the respective heights of the shorter and longer wiper blades 31 and 30 from the collection surfaces 33 of the structural member 32 (or blade notches 35) to the cleaning edges 60 are about 5.0 +/−0.25 mm and 5.5+/−0.25 mm, respectively.

In a preferred embodiment, the cleaning edges 60 are skived to have very short radii (not shown), and the blades have a width along the cleaning edge 60 of about 18.4 mm.

Ink which drips from the blades and ink droplets ejected against the planar collection surface 33 of structural member 32 are pulled under the influence of the force of gravity towards the lower portion of the structural member where opening 34 directs the ink to an absorbent material 41 held in a recess at the back portion of the structural member.

Known wiper materials such as urethanes swell in the presence of inks. It is desired to provide wiper blades comprising materials which have a decrease in swell. However, in addition to providing a material with reduced swell, it is desired to provide a material that is strong, tough, and has an extended blade life. Known urethane materials have not provided the desired results of reduced swell, and toughness.

Known blade materials such as fluoroelastomers exhibit the properties of increased toughness and reduced swell, but are relatively expensive. For example, VITON® from DuPont, can cost as much as $1,000/pound.

Moreover, known wiper blade materials can be formed by spincasting and are not easily moldable. It is desired to provide a material that can be molded to any shape or form.

It is therefore desired to provide a wiper blade material that is robust, exhibits a decrease in swell property, is moldable and is cheaper than known materials.

Urethanes are typically formed by the reaction of a polyisocyanate and a compound containing hydroxyl groups according to the general reaction: $R_aNCO+R_bOH \rightarrow R_aNHCOOR_b$, wherein $R_b$ is an ester for the formation of a polyester urethane and an ether for the formation of a polyether urethane In embodiments of the present invention, a relatively hard polyether urethane is used as the wiper blade material. The polyether urethane is generated by the general reaction of a polyol with a polyisocyanate. A curing or crosslinking agent is usually added. In addition, a catalyst may be added to speed up the reaction and crosslinking.

Examples of suitable polyisocyanates include the diisocyanates selected from the group consisting of diphenylmethane diisocyanates or methylene diisocyanate (MDI), toluene diisocyanates (TDI), naphthalene diisocyanates (NDI), meta and para tetramethylenezylene diisocyanate (TMXDI), isophorone diisocyanate (IPDI), and blends thereof. Preferred polyisocyanates include methylene diisocyanate (MDI), toluene diisocyanates (TDI), naphthalene diisocyanates (NDI), and the like. Examples of specific diisocyanates include diphenyl methane diisocyanates such as 4,4'diphenylmethane diisocyanate, 2,4'diphenylmethane diisocyanate, 2,2'diphenylmethane diisocyanate; and also include 2,4-toluene diisocyanate, 2,6-toluene diisocyanate, naphthalene 1,5-diisocyanate, 2,4-toluenediisocyanate, 1,5-naphthalenediisocyanate, diphenylmethane-4, 4'diisocyanate, an polyfunctional modified polyisocyanate, as well as their isomers, and mixtures thereof.

Examples of suitable polyols include polypropylene-based polyetherpolyol, polyethylene-based polyetherpolyol, polytetramethylene-based polyetherpolyol, copolymerized polyether-based polyol, and mixtures of these polyol components.

The functional NCO groups of the urethane provide a relatively hard and rigid segment in the final polymer chain and act very much like a filler to provide a tough, but flexible, structure that has both hard and soft domains.

Millable gumstocks are urethanes with an excess of polyol and not isocyanate. Commercial examples of such millable gumstocks include MILLATHANE®, VIBRATHANE®, AND ADIPRENE®. Millable gumstocks can be cured with either sulfur, peroxide or isocyanate.

In fact, most urethanes can be sulfur cured or peroxide cured. In a preferred embodiment, the polyether urethane material is peroxide cured. Sulfur curatives include benzothiazyl disulfide (MBTS) and mercapto benzothiazole (MBT). Peroxide curatives include dicumyl peroxide and the like. The peroxide curatives have been shown to result in more crosslinked urethanes, thus providing increased resistance to swelling.

In a preferred embodiment, the urethane is an MDI-based urethane and preferably, a diphenymethane diisocyanate urethane. In a preferred embodiment, the urethane is a millable gumstock, preferably a polyether polyurethane millable gum. An available (diphenylmethane diisocyanate) polyether urethane is S-914A made by TSE Industries, Clearwater, Fla. This material can be purchased at about $10.00/pound, as compared to VITON® materials which can cost up to about $1,000.00/pound. In a particularly preferred embodiment, the polyether urethane is peroxide cured.

Chain extenders in embodiments of the present invention, such as bifunctional or trifunctional extenders which act as crosslinking agents, can be used in preparing the polyether urethane. Typically, suitable bifunctional crosslinking agents are of the formula $OH(R_1)OH$ where $R_1$ is a straight or branched chain alkyl group having from about 2 to about 12 carbon atoms, such as methyl, ethyl, butyl, tert-butyl, and the like. Suitable trifunctional crosslinking agents are generally of the formula $R'\text{-}C\text{-}[\text{-}(OH)_a(CH_2OH)_b]$ where R' is H, $CH_3$ or $C_2H_5$, a is a number 0 or 1, b is a number 2 or 3 and a+b=3. Typical bifunctional chain extenders include ethylene glycol, 1,4 butanediol (BDO), 1,3 butanediol, 1,6 hexanediol; and neopentyl glycol, because these crosslinking agents extend the polymer chain linearly yielding tough wear resistant materials. Examples of trifunctional and higher functional chain extenders include hydroquinonediethylolether, bisphenol A, glycerol, trimethylolpropane (TMP), and trimethylolethane primarily because they crosslink the polymer chains at 90° and yield very set resistant networks. Preferred chain extenders include 1,4 butanediol; 1,6 hexanediol; 1,3 butanediol; trimethylolpropane; trimethylolethane; and the like. The bifunctional butanediol acts to extend the chain in a linear way to provide linear soft sites thereby providing the greatest toughness in the final elastomer. Trifunctional trimethylolpropane provides a superior compression set performance primarily because it is trifunctional and provides crosslinking exchange sites to tighten up the network, thereby providing a crosslinked three-dimensional network.

Catalysts can be used to produce the polyether urethane. Examples include tertiary amines such as POLYCAT® 33, POLYCAT® 41, phosphines P-308 and the like.

The polyether urethane elastomer of the wiper blade may be made according to any suitable procedure. A stable hydroxy-terminated urethane rubber can be formulated using a one shot process. It can then be mixed with a curative (for example isocyanate, water, peroxide, sulfur or like curative), and processed using conventional rubber processing equipment. For example, all the reactive ingredients including the catalyst may be added at one time or serially to a single reactor vessel to produce the polyether urethane elastomer. However, the resulting reaction is not very controlled in that there are two reactions taking place simultaneously. Thus, formation of an optional prepolymer, chain extension and crosslinking all occur at the same time.

Prepolymers are not used in the manufacture of gum stock materials. Subsequently, after the crosslinking reaction has been initiated, the formed polyether urethane may be shaped according to any of the conventional rubber forming/shaping mills. It can also be shaped by injection molding, die cutting techniques including injection molding, or like shaping techniques. It is preferred not to spin cast or flow coat the solid rubber.

The polyether urethane is relatively hard, with increased robustness. The durometer of the urethane is from about 65 to about 80, and preferably from about 70 to about 75 Shore A.

The hardness of the blade material of the present invention is greater than known blade materials which are usually around 70 Shore A. The hardness is measured according to ASTM D2240 (5 plies). The hardness is a measure of the stiffness of the blade.

It is desired that the coefficient of friction for the wiper blade be low so as to allow the blade to slide smoothly over the ink jets so that the cartridge does not stall nor the coating on the front of the die removed resulting in front face flooding and print defects.

The compression set is a measure of how quickly the blade springs back into its original shape. It is the permanent deformation that takes place in a material under sustained compression forces, and is measured according to ASTM D395, Method B(1). This method of measuring describes the experimental conditions, procedures and specimen geometry for testing compression set. The preferred compression set may be from about 1% to about 10%, and preferably 5%. It is desired that the blade have a low compression set to allow the blade to spring back into shape after coming into contact with excess ink and debris.

Another advantage of the polyether urethane blade of the present invention is that a polyether urethane is more stable to hydrolysis than is polyester urethane. This is important in that the wiper blade of the present invention is less susceptible to degradation due to humidity. When the blade is used in an ink jet process, the polyether urethane blade will have a longer wear life due to its increased stability to changes in the environment.

Swell is a measure of how much solvent the material takes up. The less the material absorbs, the more chemically resistant it is. This absorption is also a rough measure of crosslink density. As the crosslink density increases, chemical resistance increases. Crosslink density cannot be infinite because as it increases, tear strength decreases. In addition, wiper blades are exposed intermittently to waterbased inks. If the blades have a weight gain of greater than about 10%, then when they dry out in use wiper blades have a tendency to warp. This warping then prevents removal of excess ink from the front face of the die. The polyether urethane material exhibits a decrease in swell properties which, in turn, results in a longer blade life.

The wiper blade can be used with many types of inks, including thermal ink jet inks. Suitable inks for use with the blade include black inks, and colored inks such as cyan, magenta, yellow, and other known, commercially-available inks.

In general, the polyether urethane wiper blade application requires a material that possesses sufficient hardness, low compression set, moderate resiliency and low friction. The blade properties enable the blade to remove the ink and debris agglomerates, increase service life and reliability. Further, the polyether urethane wiper blade provides for a decrease in swell when in contact with ink materials. In addition, the polyether urethane wiper blade material can be molded, and is relatively inexpensive.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

EXAMPLE 1

MDI-based Polyether Polyurethane Millable Gum Wiper Blade

An MDI-based polyether polyurethane millable gumstock wiper blade material was purchased from TSE industries. The blade had a durometer of about 75. The blade was positioned onto a print head of an ink jet machine (Xerox XJ4c). The wiper blade was swiped across a print head and ink was collected via a Q-Tip® swab after 2.5 seconds with a dwell time of 1.0 seconds. The wiper speed was set at about 5.0 i.p.s. The wiper blade dimensions were approximately 11.5 to 11.75×1.0×10.0 mm with a free length ranging from about 5.0 to about 6.0 mm. The wiper blade print head interference varied from about 1.25 to about 2.5 mm.

Figure 2:
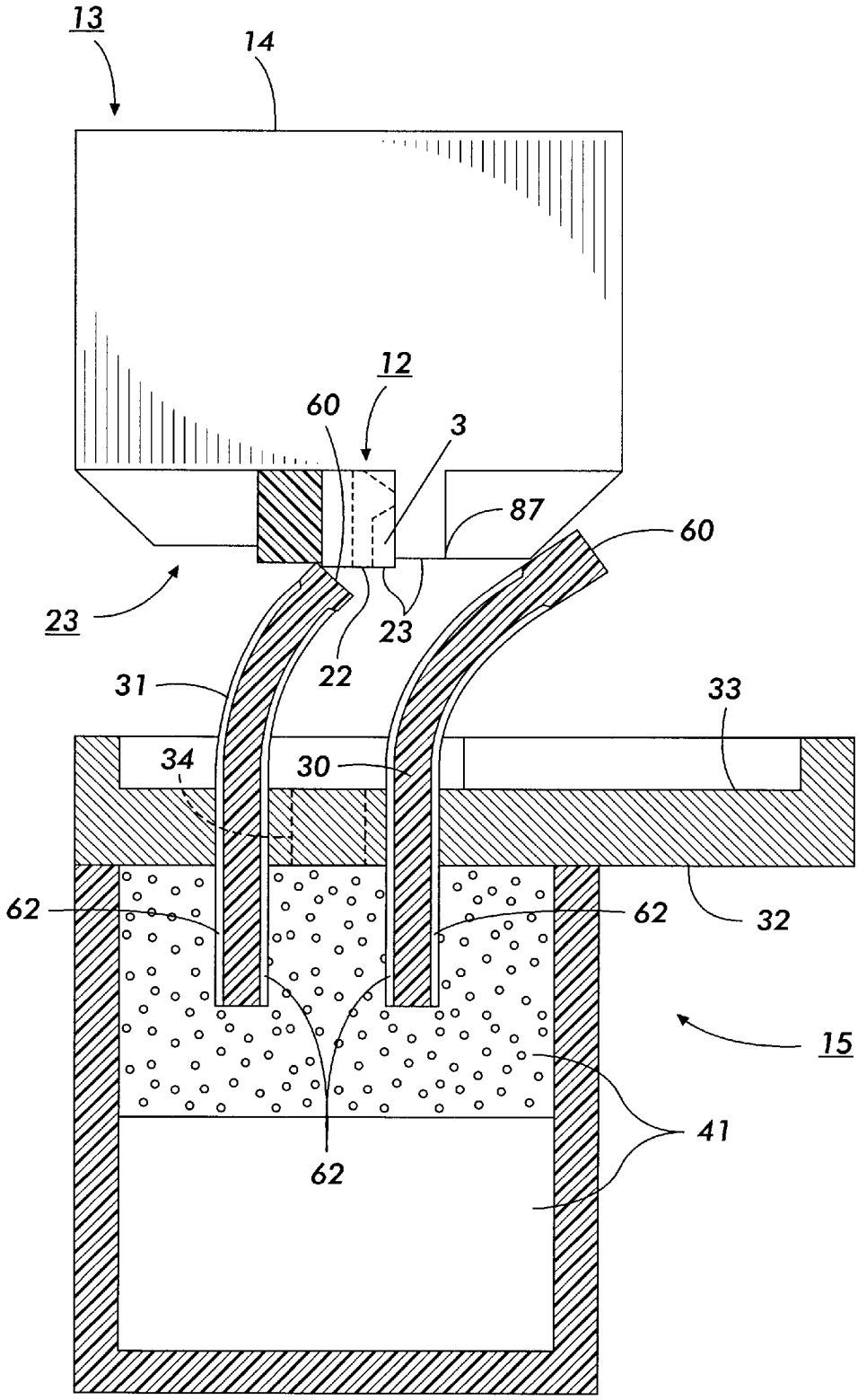
FIG. 2 is a schematic plan view showing an embodiment of a printhead nozzle face being cleaned by the cleaning blade assembly, and the wiper blades thereof being cleaned by capillary action of the grooves in each surface of the blades.

FIG. 3 demonstrates the concepts of free length and interference. Blade 31 is held in place by fixed structural member 32 and extends to ink supply cartridge 14. As shown in FIG. 2, blade 31 is bent to allow cleaning of the supply cartridge 14. In FIG. 3, blade 31 is shown in a straight line in order to demonstrate the amount of area the blade would extend 31 past the bottom of the ink supply cartridge 14 in the event the print head 3 was not present. The blade 31 bends more as the free length 1 is increased. The free length 1 is the distance the blade 31 extends past the print head 3 of the ink supply cartridge 14. The greater the free length 1, the more bent the blade 31. Also demonstrated in FIG. 3 is the interference 2 or the distance from the fixed structural member 32 (which holds the blade 31) to the print head 3 of the ink supply cartridge. This distance demonstrates how far away from the print head 3 the blade 31 is positioned.

In the experiment, the print head moved at 2.5 seconds with a 1.0 second dwell. The print head was placed in a linear wiping fixture. The blade wiped the print head from left to right. The following samples were collected: a) ink splatter was collected, b) a sample of ink was swiped from the wiper blade using a Q-Tip® swab, and was weighed, and c) a sample of ink from the print head was also swiped and weighed. The results in Table 1 below show the percentage ink removed by the wiper blade. The results demonstrate that the blade material worked very well, giving very high percentage cleaning performance. In addition, the polyether urethane is less susceptible to swell, and has a decreased cost over known materials.

TABLE 1

| Interference (mm) | Free Length (mm) | Percentage Ink Removed (Black Print Head) | Percentage Ink Removed (Cyan/Magenta/ Yellow Print Head) |
|---|---|---|---|
| 1.25 | 5.0 | 96% | 97–99% |
| 2.5 | 5.0 | 96% | 96% |
| 2.0 | 6.0 | 88% | 98% |

TABLE 1-continued

| Interference (mm) | Free Length (mm) | Percentage Ink Removed (Black Print Head) | Percentage Ink Removed (Cyan/Magenta/ Yellow Print Head) |
|---|---|---|---|
| 2.0 | 5.0 | 96% | 98% |
| 1.25 | 6.0 | 75% | 97–99% |

EXAMPLE 2

Known Polyurethane Wiper Blade

A known polyurethane wiper blade used in a Xerox ink jet machine (Xerox XJ4c) was positioned onto a print head of the Xerox ink jet machine. The wiper blade was swiped across a print head and ink was collected via a Q-Tip® swab after 2.5 seconds with a dwell time of 1.0 seconds. The wiper speed was set at 5.0 i.p.s. The wiper blade dimensions were approximately 11.0×1.0×10.0 mm with a free length ranging from about 1.0 to about 3.5 mm. The wiper blade print head interference varied from about 1.0 to about 3.5 mm.

The print head moved at 2.5 seconds with a 1.0 second dwell. The print head was placed in a linear wiping fixture. The blade wiped the print head from left to right. The following samples were collected: a) ink splatter sample was collected, b) a sample of ink was swiped from the wiper blade using a Q-Tip® swab, and was weighed, and c) a sample of ink from print head was also swiped and weighed. The results in Table 2 below show the percentage ink removed by the wiper blade. The results demonstrate that known wiper blade polyurethane materials exhibit good cleaning performance. However, known urethane materials tend to swell, and therefore, have a decreased blade life.

TABLE 2

| Interference (mm) | Free Length (mm) | Percentage Ink Removed (Black Print Head) | Percentage Ink Removed (Cyan/Magenta/ Yellow Print Head) |
|---|---|---|---|
| 2.5 | 5.0 | | 83% |
| 3.5 | 7.0 | | 88% |
| 2.5 | 5.0 | 92% | |
| 1.5 | 5.0 | 79% | |
| 2.0 | 5.0 | 96% | 98% |
| 1.0 | 3.0 | 87–88% | 94% |
| 1.0 | 5.0 | 96% | 96% |
| 1.25 | 5.0 | 96% | 94% |
| 1.5 | 5.0 | 92% | 90% |
| 2.5 | 5.0 | 96% | 96% |
| 2.75 | 5.0 | 79% | 87% |

EXAMPLE 3

Comparison of Results

Table 3 below demonstrates a comparison of the results of the above two experiments by matching the data from the same interferences and same free lengths. The below results show that the wiper blade of the present invention exhibits the same or better results over known polyurethane blades, but without the swell, added cost, and decreased life of known blades.

TABLE 3

| Intf. (mm) | Free Length | % ink Blk PH known wiper blade | % ink CMY PH known wiper blade | % ink Blk invent. Wiper blade | % ink CMY Invent. wiper blade |
|---|---|---|---|---|---|
| 1.25 | 5.0 | 96% | 94% | 96% | 97–99% |
| 2.5 | 5.0 | 92% | 83% | 96% | 96% |
| | | 96% | 96% | | |
| 2.0 | 5.0 | 96% | 98% | 96% | 98% |

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. An ink jet assembly comprising:

a) a printhead having at least one nozzle to disperse inks;

b) a wiper blade assembly positioned for cleaning ink and other debris from the at least one printhead nozzle, wherein said wiper blade assembly comprises at least one wiper blade, and wherein said wiper blade comprises a peroxide cured polyether urethane.

2. An ink jet assembly in accordance with claim 1, wherein said wiper blade has a hardness of from about 65 to about 80 Shore A.

3. An ink jet assembly in accordance with claim 2, wherein said wiper blade has a hardness of from about 70 to about 75 Shore A.

4. An ink jet assembly in accordance with claim 1, wherein said polyether urethane is the reaction product of a polyol and a polyisocyanate.

5. An ink jet assembly in accordance with claim 4, wherein said polyisocyanate is a diisocyanate.

6. An ink jet assembly in accordance with claim 5, wherein said diisocyanate is selected from the group consisting of diphenylmethane diisocyanates, toluene diisocyanates, naphthalene diisocyanates, methane diisocyanates, and mixtures thereof.

7. An ink jet assembly in accordance with claim 6, wherein said diisocyanate is diphenyl methane diisocyanate.

8. An ink jet assembly in accordance with claim 1, wherein said polyether urethane is a gum stock material.

9. An ink jet assembly in accordance with claim 1, wherein said polyether urethane is a peroxide-cured diphenyl methane diisocyanate gum stock material.

10. An ink jet assembly in accordance with claim 1, wherein said inks dispersed from said nozzles are thermal ink jet inks.

11. An ink jet assembly in accordance with claim 10, wherein said thermal ink jet inks are selected from the group consisting of black, cyan, magenta and yellow inks.

12. An ink jet assembly in accordance with claim 1, wherein said wiper blade assembly comprises at least two wiper blades.

13. An ink jet assembly comprising:

a) a printhead having at least one nozzle to disperse inks;

b) a wiper blade assembly positioned for cleaning ink and other debris from the at least one printhead nozzle, wherein said wiper blade assembly comprises at least one wiper blade, and wherein said wiper blade comprises a peroxide cured diphenylmethane diisocyanate polyether urethane.

14. A process for cleaning ink and other debris from a surface of at least one printhead nozzle in an ink jet assembly comprising:

a) dispersing inks from at least one printhead nozzles to a substrate;

b) cleaning said ink and other debris from said at least one printhead nozzle by positioning a wiper blade assembly comprising at least one wiper blade so that said wiper blade cleans said ink and other debris from the at least one printhead nozzle, wherein said wiper blade comprises peroxide cured polyether urethane.

15. A process in accordance with claim 14, wherein said wiper blade has a hardness of from about 70 to about 75 Shore A.

16. A process in accordance with claim 14, wherein said polyether urethane is a gum stock material.

17. A process in accordance with claim 14, wherein said polyether urethane is the reaction product of a polyol and a polyisocyanate.

18. A process in accordance with claim 17, wherein said polyisocyanate is selected from the group consisting of diphenylmethane diisocyanates, toluene diisocyanates, naphthalene diisocyanates, methane diisocyanates, and mixtures thereof.

19. A process in accordance with claim 18, wherein said diisocyanate is diphenyl methane diisocyanate.

* * * * *